US006231267B1

(12) United States Patent
Pearl

(10) Patent No.: US 6,231,267 B1
(45) Date of Patent: May 15, 2001

(54) THREADED PLUG DEVICE FOR ATTACHMENT TO A TRENCH PLATE FOR REMOVABLE ATTACHMENT OF A HOIST RING

(75) Inventor: Fred R. Pearl, Westminster, CA (US)

(73) Assignee: Actek Enterprises, Inc., Santa Fe Springs, CA (US)

( * ) Notice: Subject to any disclaimer, the term of this patent is extended or adjusted under 35 U.S.C. 154(b) by 0 days.

(21) Appl. No.: 09/345,430

(22) Filed: Jul. 1, 1999

Related U.S. Application Data

(60) Provisional application No. 60/091,390, filed on Jul. 1, 1998.

(51) Int. Cl.[7] ..... E02D 29/14; F16B 37/06

(52) U.S. Cl. ..... 404/25; 411/171; 294/1.1; 294/89

(58) Field of Search ..... 411/171, 172, 411/400, 401, 427; 294/1.1, 89; 404/25

(56) References Cited

U.S. PATENT DOCUMENTS

| | | | | |
|---|---|---|---|---|
| 1,792,711 | * | 2/1931 | Rockstad | 411/427 |
| 2,250,580 | * | 7/1941 | Gregory | 411/427 |
| 2,674,485 | * | 4/1954 | Jamison . | |
| 3,219,790 | * | 11/1965 | Johnson | 411/171 |
| 3,297,293 | * | 1/1967 | Andrews . | |
| 3,710,468 | * | 1/1973 | Calvert . | |
| 3,920,347 | * | 11/1975 | Sauriol . | |
| 4,170,918 | * | 10/1979 | Burge | 411/427 |
| 4,600,332 | * | 7/1986 | Sharp | 411/171 |
| 4,770,584 | * | 9/1988 | Vinciguerra | 411/427 |
| 4,973,191 | * | 11/1990 | Dannhauser . | |
| 5,713,695 | * | 2/1998 | Rogers . | |

* cited by examiner

*Primary Examiner*—Flemming Saether
(74) *Attorney, Agent, or Firm*—Stout, Uxa, Buyan & Mullins LLP

(57) ABSTRACT

A pair of high-quality material threaded nuts are secured to a trench plate for subsequent placement of a hoist ring thereto.

12 Claims, 5 Drawing Sheets

THREADED PLUG DEVICE FOR ATTACHMENT TO A TRENCH PLATE FOR REMOVABLE ATTACHMENT OF A HOIST RING

This application claims the benefit of U.S. Provisional Application Ser. No. 60/091,390, filed Jul. 1, 1998 and entitled THREADED PLUGS, the contents of which are expressly incorporated herein by reference.

BACKGROUND OF THE INVENTION

1. Field of the Invention

The present invention relates generally to fastening devices and, more particularly, to threaded plugs for attachment to trench plates for accommodating swivel hoist rings therein.

2. Description of Related Art

Steel trench plates are used to cover trenches in streets and roadways in order to facilitate traffic flow during construction or repair. In order to lift a steel trench plate, one or more fastening devices, such as hoist rings, are typically secured to the steel trench plate. Prior art fastening devices have included threaded rods formed into a loop and permanently affixed to the steel trench plate. Swivel hoist rings have also been used as fastening devices for steel trench plates. A typical swivel hoist ring, such as disclosed in U.S. Pat. No. 3,297,293 to Andrews et al., may comprise an eye member which is pivotally and rotationally mounted onto a base.

SUMMARY OF THE INVENTION

In accordance with the present invention, threaded plugs are secured into a steel trench plate for removably accommodating fastening devices thereto. Even though the steel trench plate may be formed of common, commercial grade steel, each threaded plug is formed of high-quality, 4140 chrome molly aircraft steel, which is heat treated to Rockwell standard hardness. Moreover, the tolerance of each threaded plug is precisely controlled, and each threaded plug is preferably formed to have a round head, which is then beveled, before the threaded plug is permanently secured to the steel trench plate.

The present invention, together with additional features and advantages thereof, may best be understood by reference to the following description taken in connection with the accompanying illustrative drawings.

DETAILED DESCRIPTION OF THE PRESENTLY PREFERRED EMBODIMENT

Figure 1:
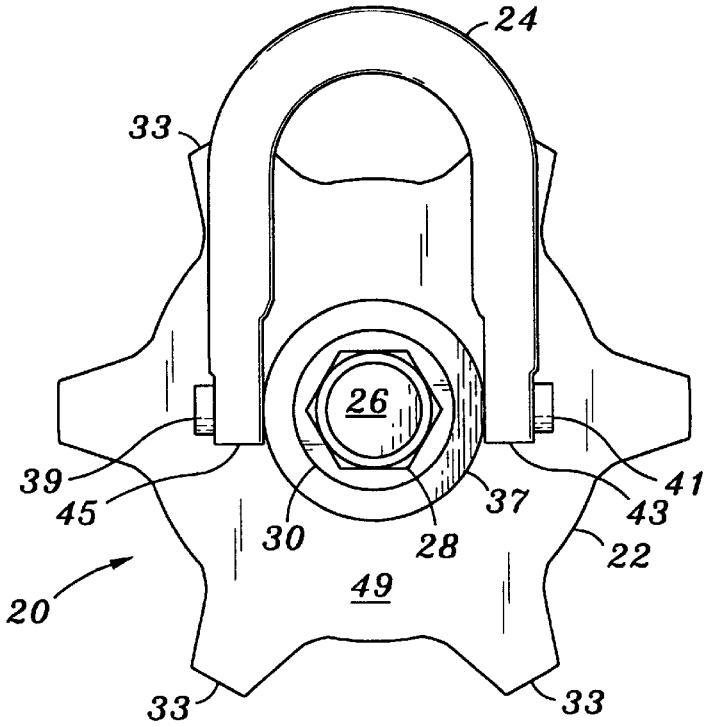
FIG. 1 illustrates a top-planar view of a trench plate connector in accordance with the present invention.

Referring more particularly to the drawings, FIG. 1 illustrates an exemplary fastening device that can be used with the threaded plugs 15 (FIG. 6) of the present invention. The trench plate connector 20 comprises a large-diameter skirt member 22, an eye member 24, a double-threaded stud 26, a nut 28, and a circular plate 30. The large-diameter skirt member 22 comprises a number of arms 33 and a threaded aperture 52 (FIG. 3) for accommodating the double-threaded stud 26. The large-diameter skirt member 22 is preferably manufactured to have a diameter of approximately nine inches, and each of the arms 33 is preferably manufactured to have a width at a distal end of approximately one inch.

The eye member 24 is secured to a load ring 37 via two pivot pins 39, 41. Each of the two pivot pins 39, 41 passes through an aperture of the eye member 24 and, subsequently, through a corresponding aperture in the load ring 37. (See FIG. 5.) The eye member 24 is shown in FIG. 1 in an off-axis position, relative to an axis of the stud 26. In the configuration of FIG. 1, the eye member 24 is pivoted about an axis formed by the pivot pins 39, 41 in a direction toward the top of the page. In addition to being pivotable about an axis formed by the pivot pins 39, 41, the eye member 24 is rotatable about an axis of the double-threaded stud 26.

Figure 2:
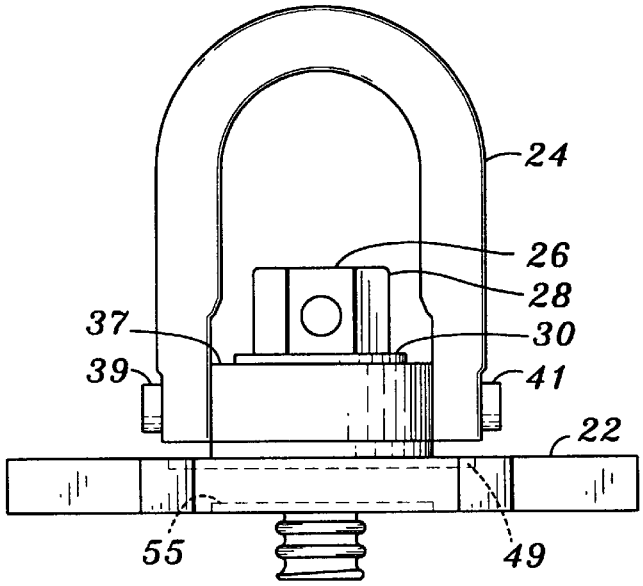
FIG. 2 illustrates a side-elevational view of a trench plate connector in accordance with the present invention.

FIG. 2 illustrates a side-elevational view of the trench plate connector 20. As can be seen from the phantom line 49, the large-diameter skirt member 22 comprises a recessed area 49. The recessed area 49 provides clearance for the ends 43, 45 of the eye member 24, as the eye member 24 is rotated about the axis of the double-threaded stud 26 in a pivoted position, such as shown in FIG. 1. A clearance between the ends 43, 45 of the eye member 24 and the recessed area 49 is greater when the eye member 24 is in a non-pivoted orientation, as illustrated in FIG. 2. As shown in FIG. 2, a thickness of the large-diameter skirt member 22 is preferably ⅝ inch, and a thickness of the eye member 24 is preferably one inch. An exterior width of the eye member 24 is preferably 4.8 inches, and an interior width of the eye member 24 is preferably 2.8 inches. A height of the eye member 24 is preferably 7.5 inches, and a height of the eye member and the large-diameter skirt member together is approximately 6.96 inches. The components shown in FIG. 2 preferably comprise 4140 aircraft quality, heat-treated steel, with a finish comprising oil black oxide. The trench plate connector preferably comprises a safety factor of 5 to 1, and a rated load of approximately 10,000 pounds.

Figure 3:
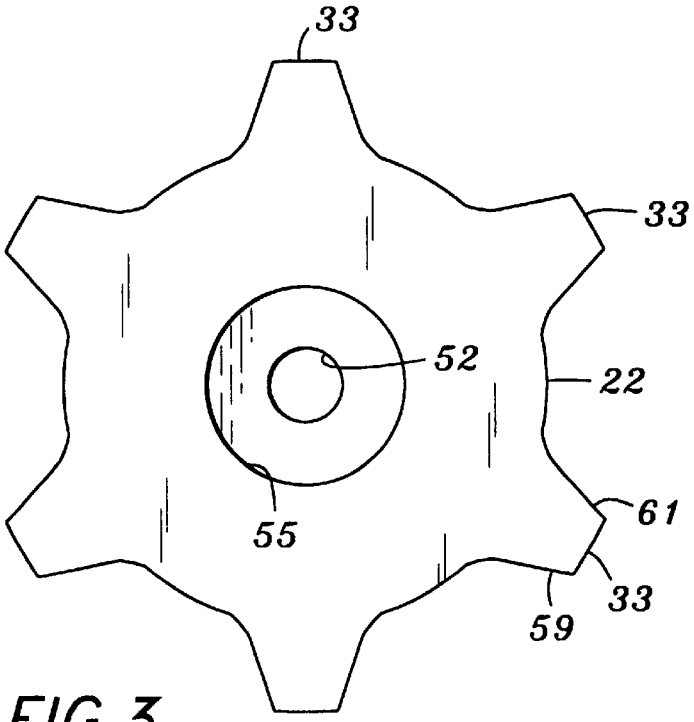
FIG. 3 illustrates a bottom view of a large-diameter skirt member in accordance with the present invention.

FIG. 3 illustrates a bottom view of the large-diameter skirt member 22. The large-diameter skirt member 22 comprises a threaded aperture 52 for accommodating the double-threaded stud 26. A second recessed area 55 is formed in the bottom of the large-diameter skirt member 22. The second recessed area 55 is adapted to accommodate a portion of one of the thread plugs 115 (FIG. 6) of a trench plate. The second recessed area 55 helps to ensure that the entire bottom surface of the large-diameter skirt member 22, with possibly the exception of the second recessed area 55, contacts the surface of the trench plate. When the bottom surface of the large-diameter skirt member 22 fits flush against the upper surface of a trench plate, horizontal forces exerted on the eye member 24 and transferred to the double-threaded stud 26, are subsequently transferred from the bottom surface of the large-diameter skirt member 22 onto the upper surface of the trench plate. All of the forces are therefore not concentrated only on the stud 26. Horizontal forces are defined herein as forces which are off-axis to the axis of the double-threaded stud 26.

Each arm 33 comprises two surfaces 59, 61, which are angled approximately radially outwardly from a center of the large-diameter skirt member 22. Each of the surfaces 59, 61 is adapted for receiving a rotational force for either threading the double-threaded stud 26 into a threaded nut of the trench plate or unthreading the double-threaded stud 26 therefrom. A hammer, for example, may be applied onto the surface 61 in order to apply rotational forces thereto. In an alternative embodiment, the arms 33 may be extended radially outwardly in order to accommodate rectangular cross-sectional pipes, for example.

Figure 4:
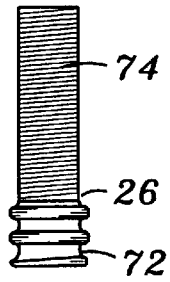
FIG. 4 illustrates a side-elevational view of a double-threaded stud in accordance with the present invention.

FIG. 4 illustrates a side-elevational view of the double-threaded stud 26. The double-threaded stud 26 comprises a first portion of threads 72, which are preferably adapted for being threaded into the threaded plugs 115 (FIG. 6) of the trench plate. The double-threaded stud 26 further comprises a second portion of threads 74, which are adapted for being threaded into both the aperture 52 of the large-diameter skirt member 22 and the nut 28. The large distance of the arms 33 from a center portion of the large-diameter skirt member 22 facilitates the application of high-torque forces onto the large-diameter skirt member 22 and, subsequently, onto the double-threaded stud 26.

Figure 5:
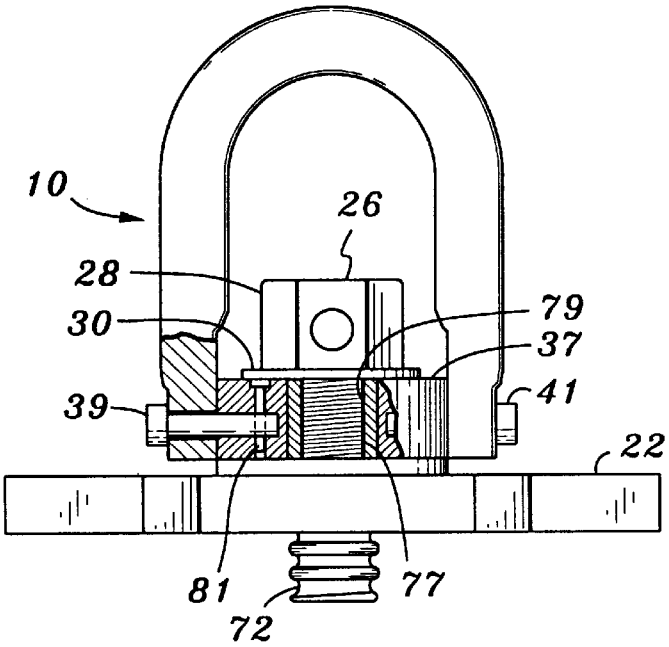
FIG. 5 illustrates a partial cross-sectional view of a trench plate connector in accordance with the present invention.

FIG. 5 illustrates a partial cross-sectional view of the trench plate connector 10 of the present invention. Mounted on the double-threaded stud 26 is a bushing 77, the bushing 77 having an axial bore 79 for receiving the double-threaded stud 26. The bushing 77 is rotatable about the double-threaded stud 26, and the load ring 37 is rotatable about both the bushing 77 and the double-threaded stud 26. The load ring 37 frictionally engages and is seated on a raised portion of the large-diameter skirt member 22. The load ring 37 can be freely rotated in either direction for a full 360 degrees about an axis of the double-threaded stud 26. The circular plate 30 is fitted over the double-threaded stud 26 and is located between the nut 28 on one side and the surfaces of the load ring 37 and the bushing 77 on the other side.

Each of the pivot pins 39, 41 is attached to the load ring 37 by a corresponding lock pin 81, for example, fitted into a vertical bore formed through the load ring 37 and extending through a compatible and aligned hole formed in the end of the pin 39, for example. The ends of the vertical bore containing the lock pin 81, for example, are closed by the circular plate 30 and the surface of the large-diameter skirt member 22 so as to hold the lock pin 81, for example, in place and preclude unintentional loss or disengagement.

Figure 6:
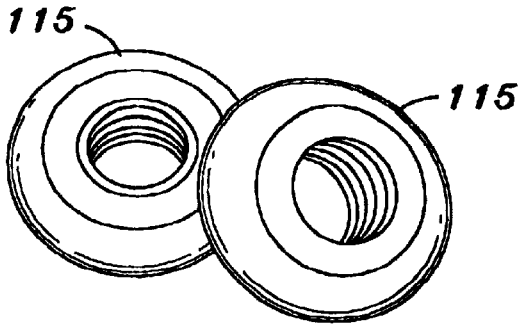
FIG. 6 is a perspective view of two threaded plugs in accordance with the present invention.

FIG. 6 shows a perspective view of two threaded plugs 115 in accordance with the present invention. An aperture is placed within a steel trench plate and, subsequently, the threaded plugs 115 are secured at opposite ends of the aperture. The threaded plugs 115, once secured within the steel trench plate, are adapted to facilitate the trench plate connector 20 (FIG. 5). The threaded plugs 115 are preferably formed of high-quality, 4140 chrome molly aircraft steel, which is heat treated to Rockwell standard hardness. Moreover, the tolerance of each threaded plug is precisely controlled, and each threaded plug is preferably formed to have a round head, which is then beveled, before the threaded plug is permanently secured to the steel trench plate. The beveled edge of the threaded plugs 115 is such that the first side may have a substantially greater surface area than the second side of the threaded plug. The high-quality steel and the close tolerance of the threaded plugs 115, along with the round shape and beveled edge of each threaded plug 115, facilitate a better fit and a better bond to the steel trench plate.

Figure 8:
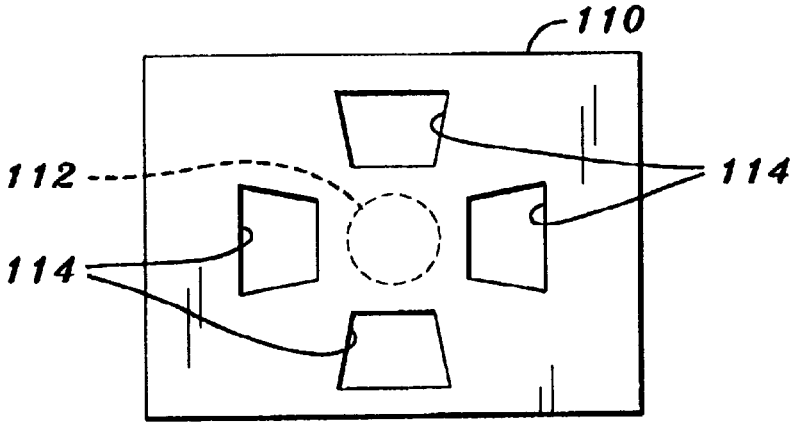
FIG. 8 is a top planar view of the plug aligning device of the presently preferred embodiment placed onto a trench plate.
Figure 7:
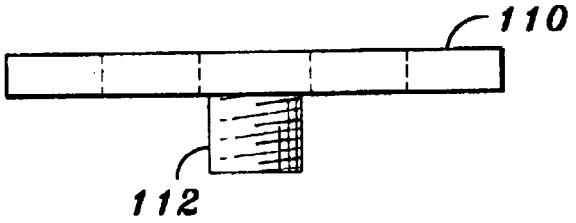
FIG. 7 is a side elevation view of a plug aligning device in accordance with the present invention.

An aperture is drilled or burnt into the steel trench plate, and the threaded plugs 115 are secured at opposing ends of the aperture using a plug aligning device 110 (FIG. 7). The plug aligning device 110 comprises a threaded rod 112 and four apertures 114, as illustrated in FIG. 8. In the illustrated embodiment, the dimensions and threads of the threaded rod 112 correspond to the first portion of threads 72 (FIG. 4) of the double-threaded bolt of the trench plate connector 20. In accordance with the presently preferred embodiment, the threads of the threaded rod 112 comprise coil or construction threads. In the illustrated embodiment, the coil threads may be 1 ¼ inch, 3 ½ pitch (3 ½ coils/inch).

Figure 9:
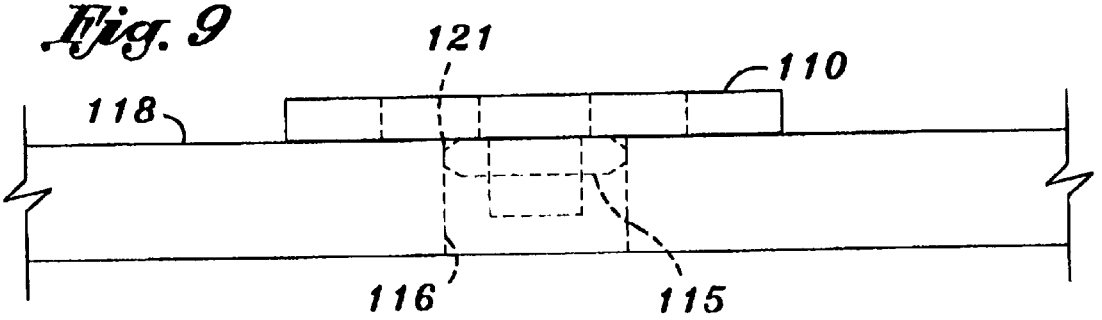
FIG. 9 is cross-sectional view of the plug aligning device of the present invention temporarily secured within a trench plate.

A first threaded plug 115 is rotated onto the threaded rod 112, preferably until the threaded plug 115 cannot be rotated anymore. As illustrated in FIG. 9, the threaded rod 112 of the plug aligning device 110 is placed within the aperture 116 of the steel trench plate 118. An outer diameter of the threaded plug 115 corresponds to a diameter of the aperture 116 within the steel trench plate 118.

Figure 10:
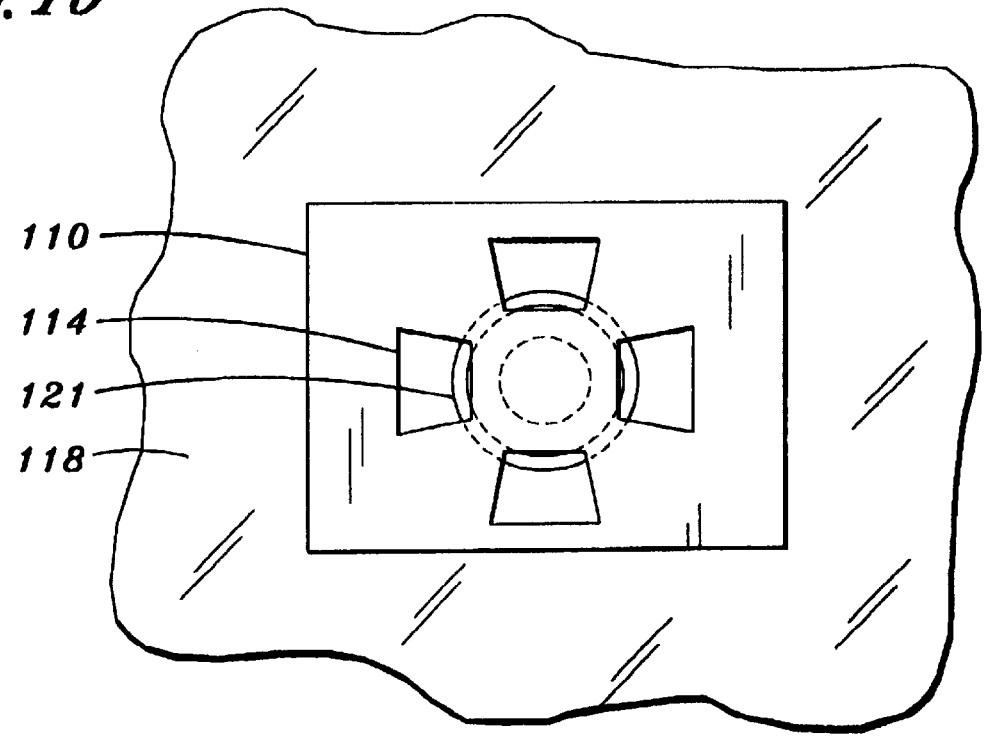
FIG. 10 is top planar view of the plug aligning device of the present invention temporarily secured within a trench plate.
Figure 11:
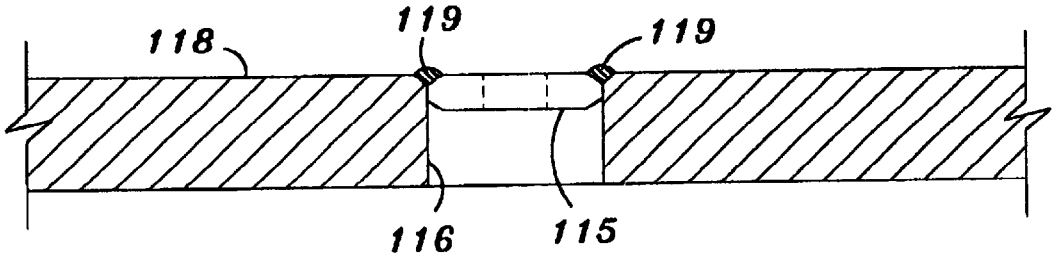
FIG. 11 is cross-sectional view of a threaded plug secured within a trench plate in accordance with the present invention.
Figure 12:
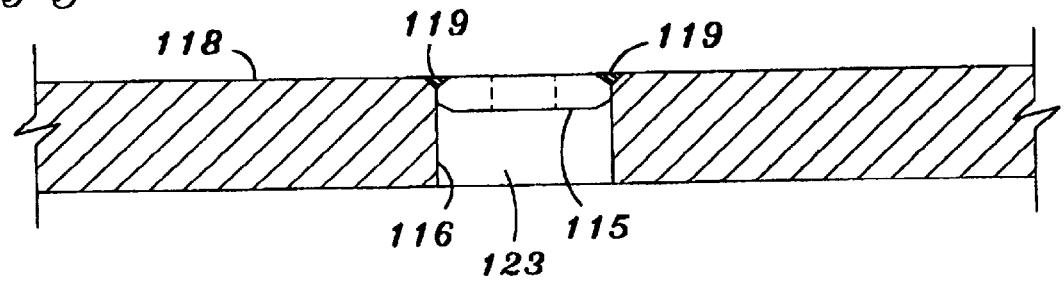
FIG. 12 is cross-sectional view of the threaded plug attachment of FIG. 11 ground flush with the exterior surface of the trench plate.

FIG. 5 illustrates a top view of FIG. 9. As can be seen from FIG. 9, the threaded plug comprises a tapered (beveled) surface which faces a surface of the plug aligning device 110. Portions of the tapered surface 121 can be seen through each of the apertures 114 in FIG. 10. In accordance with the method of the present invention, an alloy rod welding procedure, or other similar welding procedure, is used to secure the portions of the tapered surface 121 to the aperture 116 of the steel trench plate 118 with a weld. Subsequently, the plug aligning device 110 is rotated out of the threaded plug 115 and away from the steel trench plate 118. The resulting structure is illustrated in FIG. 11. The top surfaces of the welds 119 are then ground flush, as illustrated in FIG. 12. The process is repeated for the opposite end 123 of the aperture 116. The resulting structure accommodates the double-threaded bolt, or other threaded shaft, therethrough, to facilitate movement of the steel trench plate.

Another point to mention about the threaded plugs of the present invention is that they are preferably Rockwell heat 28–34 Rockwell on the C scale.

Figure 13:
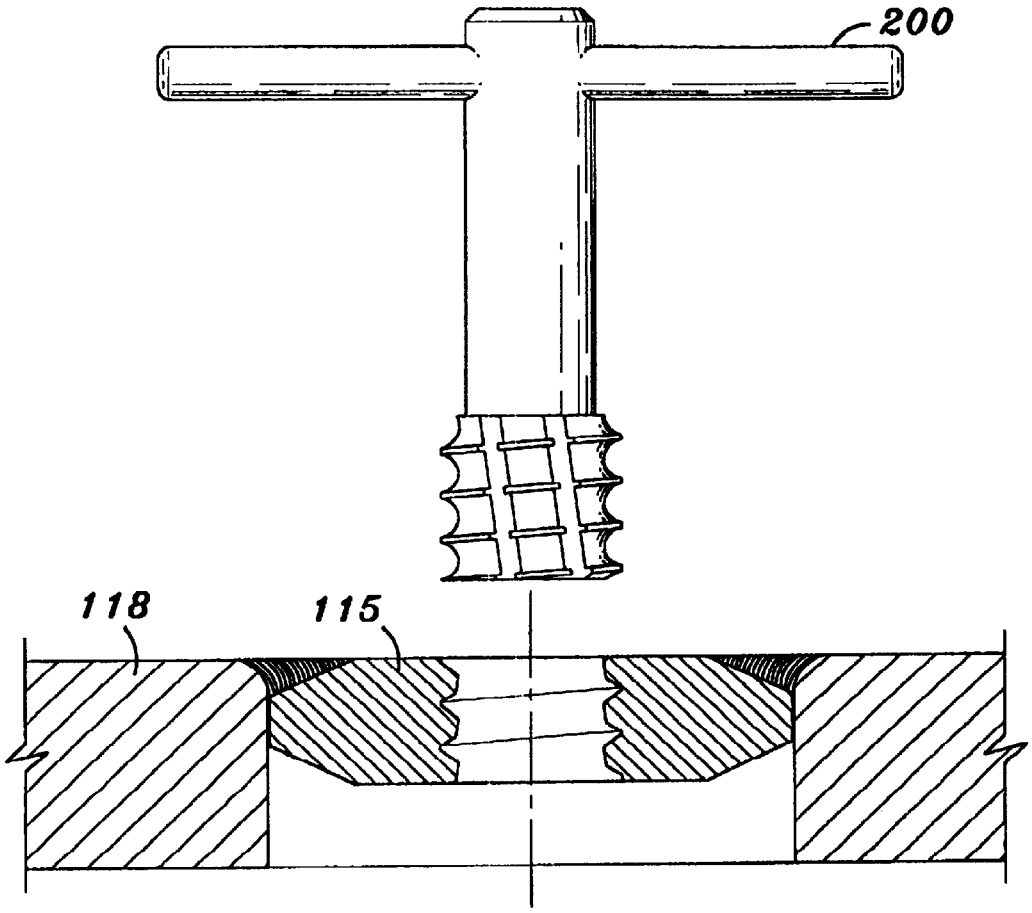
FIG. 13 illustrates a thread cleaning device in accordance with the present invention.

Referring to FIG. 13, when workers install the street plate over a street defect, they will often put cold tar on the edges of the street plate. The tar is to prevent car tire damage, for example. On occasion, the tar is transferred inadvertently into the thread. As shown in the figure, the thread cleaning device comprises a T-handle 200 welded onto a proximal end thereof and coil threads 202 disposed onto the distal end of the thread cleaning device. Flutes 204 are machined into the coil threads in a diagonal fashion, in the illustrated embodiment. The flutes preferably have an even greater diagonal orientation than that shown in FIG. 13. The flutes comprise troughs, for example, extending into the cleaner for catching and collecting debris caught in the coil threads of the plug being cleaned. The width of each flute is preferably 3/16 inch wide, in the illustrated embodiment, and the flutes are preferably diagonally disposed in the threads to facilitate a slicing action when the cleaner is rotated within the plugs. Other orientations of the flutes are also possible in modified embodiments of the present invention. The edges of the troughs of the flutes are very sharp for enhancing the cleaning operation. In accordance with one aspect of the present invention, a lubricant, such as WD40, can be sprayed onto the cleaner before use. The cleaner preferably comprise 4140 aircraft steel Rockwell treated to a hardness of 50 to 55 Rockwell.

Figure 14:
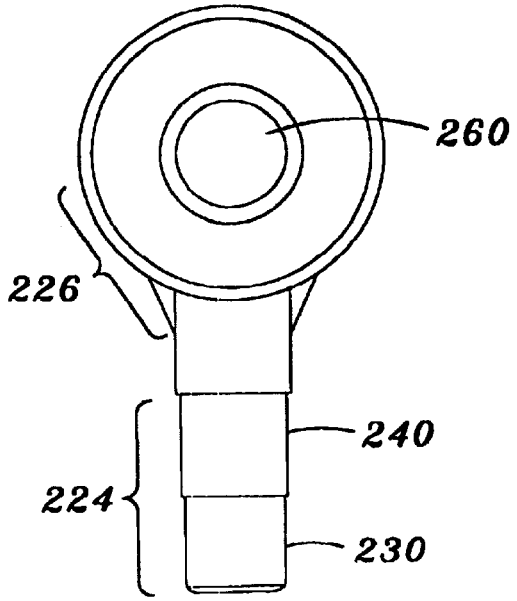
FIG. 14 illustrates a gauge for determining whether the threads of a threaded plug are sufficient to reduce the risk of malfunction.

Turning now to FIG. 14, a gauge 220 is disclosed in accordance with another aspect of the present invention. The bottom portion 224 of the gauge 220 is used to determine whether the threads of the plugs are acceptable to avoid malfunction or dropping of the street plate or other device to be lifted. The bottom portion 224 comprises a "GO" section 230 and a "NO GO" section 240. The GO section should always fit into the threaded aperture of the plug, indicating that the threads of the plug are not too worn. If the gauge 20 continues to fit further and further into the threaded aperture of the plug, into the NO GO section, then the threads are worn too much and the threaded plug should not be used for lifting the heavy item (the street plate, for example). In the illustrated embodiment, the diameter of the GO section 230 is about 1.100 inches, and the diameter of the NO GO section is about 1.150 inches, for a difference of about 50/1000 inch between the two sections. In the illustrated embodiment, a difference of about 50/1000 inch is provided for providing safe operation of the plugs for lifting loads up to weights of about 9000 pounds. Although this difference is disclosed for a 1 ¼ inch 3.5 coil threaded plug, the "difference" (here of about 50/1000 inch) would remain about the same for other sized threaded plugs (with different diameters) as well. Of course, the actual diameters, however, of the GO and NO GO sections would be different, so long as, again, the difference between the diameters would remain at the 50/1000 inch setting. Other ranges are possible depending on the operating conditions, such as the working conditions, the weight of the device being lifted, and the quality of the lifting connector (hoist ring, for example) and of the threads of the plug.

Now, the top section 226 of the gauge 220 is for testing the threads of the stud (bolt) of the lifting device (here a hoist ring as disclosed above). If the stud fits into the aperture 260 of the gauge then there is too much wear and the stud should be replaced. The rated diameter of the stud in the illustrated embodiment is 1.250 inch, and, here, the diameter of the aperture 260 is about 1.230 inch, for a difference of about 20/1000 inch. It is noted that the tolerence is less for the stud than the plugs.

The maintenance of the diameter sizes and thread cleanliness is extremely critical in the high lifting applications to which the present invention is directed. Because the stud of the lifting device (hoist ring) is screwed into the plugs (secured to the street plate, for example) very frequently, and with all of the metal to metal friction, and sand and dirt, wear and tear must be monitored. The gauge 220 preferably comprises 4140 aircraft steel Rockwell heat treated to between 50 and 55 Rockwell. In the past users would determine that the stud of the hoist ring and/or the threads of the plug have worn to the NO GO state, by watching the street plate drop unexpectedly.

Although an exemplary embodiment of the invention has been shown and described, many other changes, modifications and substitutions, in addition to those set forth in the above paragraphs, may be made by one having ordinary skill in the art without necessarily departing from the spirit and scope of this invention.

What is claimed is:

1. A threaded plug system in combination with a trench plate, comprising:

a trench plate having a first side, a second side, and an aperture connecting the first side to the second side;

a threaded plug comprising 4140 chrome molly aircraft steel that is heat treated to Rockwell-standard hardness, the threaded plug comprising a first side having a first area, a second side opposite the first side having a second area, and a perimeter portion connecting the first side to the second side, the first area of the first side being substantially greater than the second area of the second side, and the threaded plug further comprising a threaded aperture connecting the first side to the second side; and a weld joining the perimeter portion of the threaded plug to the aperture of the trench plate.

2. The threaded plug as set forth in claim 1, wherein:

the second side of the threaded plug is flush with the first side of the trench plate; and the weld is ground flush with both the second side of the threaded plug and the first side of the trench plate.

3. The threaded plug as set forth in claim 1, wherein the perimeter portion comprises a tapered surface.

4. The threaded plug as set forth in claim 3, wherein the tapered surface comprises a beveled surface.

5. The threaded plug as set forth in claim 1, wherein the first side comprises a first circular side, and wherein the second side comprises a second circular side.

6. The threaded plug as set forth in claim 1, wherein the threaded aperture comprises a coiled thread.

7. The threaded plug as set forth in claim 1, wherein the first side is substantially planar, and wherein the second side is substantially planar.

8. A threaded plug in combination with a trench plate having an aperture disposed therein, the threaded plug comprising 4140 chrome molly aircraft steel that is heat treated to Rockwell-standard hardness, and further comprising a first side having a first area, a second side opposite the first side having a second area, and a perimeter portion connecting the first side to the second side, wherein the area of the first side is substantially greater than the area of the second side, and wherein the threaded plug further comprises a threaded aperture connecting the first side to the second side, wherein a weld joins the perimeter portion of the threaded plug to the aperture of the trench plate.

9. The threaded plug as set forth in claim 8, wherein the perimeter portion comprises a tapered surface.

10. The threaded plug as set forth in claim 8, wherein the tapered surface comprises a beveled surface.

11. The threaded plug as set forth in claim 8, wherein the threaded aperture comprises a coiled thread.

12. The threaded plug as set forth in claim 8, wherein the first side is substantially planar, and wherein the second side is substantially planar.

* * * * *